US006588616B1

(12) United States Patent
Ho

(10) Patent No.: US 6,588,616 B1
(45) Date of Patent: Jul. 8, 2003

(54) WASTEPAPER BIN FOR A PAPER SHREDDER

(76) Inventor: Ming-Hui Ho, No.18, 20 Lane, Hsin Feng Street, Hsin Chuang City., Taipei Shien (TW)

( * ) Notice: Subject to any disclaimer, the term of this patent is extended or adjusted under 35 U.S.C. 154(b) by 0 days.

(21) Appl. No.: 10/175,624

(22) Filed: Jun. 19, 2002

(51) Int. Cl.[7] ..... B65D 6/26
(52) U.S. Cl. ..... 220/4.03; 220/8; 220/4.26
(58) Field of Search ..... 220/8, 4.03, 4.26, 220/503

(56) References Cited

U.S. PATENT DOCUMENTS 1,116,752 A * 11/1914 Stolk ..... 220/8
1,827,396 A * 10/1931 Luckett ..... 220/8
2,522,768 A * 9/1950 Wigpert ..... 220/23.87
3,175,853 A * 3/1965 Gilbertson ..... 292/86
3,395,787 A * 8/1968 Plaskan ..... 206/259
4,527,707 A * 7/1985 Heymann et al. ..... 220/571
4,574,776 A * 3/1986 Hidle ..... 220/23.87
4,724,976 A * 2/1988 Lee ..... 220/8
5,060,799 A * 10/1991 De Pagter ..... 206/423
5,662,026 A * 9/1997 Prakasa ..... 99/413
5,715,962 A * 2/1998 McDonnell ..... 220/4.03
5,829,591 A * 11/1998 Lyons ..... 206/373
6,026,685 A * 2/2000 Weterrings et al. ..... 73/429

* cited by examiner

*Primary Examiner*—Joseph M. Moy
(74) *Attorney, Agent, or Firm*—Pro-Techtor International Services

(57) ABSTRACT

A wastepaper bin for a paper shredder includes a bottom portion member disposed with a wastepaper bin in a bucket shape and an elastic clamping device disposed adjacent to a top end area thereof; a top portion member slidably inserted onto the exterior portion of the bottom portion member is assembled by a unitarily molded peripheral wall and has a clamping device disposed in the area of a lower opening for retaining the elastic clamping device thereby fastening the top portion member on the bottom portion member; an unclamping device is disposed on the peripheral wall of the top portion member; a supporting device for supporting a main body of the paper shredder is disposed adjacent to the upper opening area of the top portion member; the wastepaper bin is capable of tremendously reducing the transportation and storage cost of the paper shredder.

6 Claims, 5 Drawing Sheets

WASTEPAPER BIN FOR A PAPER SHREDDER

BACKGROUND OF THE INVENTION

1) Field of the Invention

The present invention relates to a wastepaper bin for a paper shredder, more especially to a collapsible wastepaper bin for a paper shredder.

2) Description of the Prior Art

A traditional wastepaper bin of a paper shredder is usually a unitarily molded one-piece wastepaper bin. When in use, a main body of the paper shredder is inserted and erected on the top rim of the paper shredder for dropping the crumpled paper into the wastepaper bin. Although this kind of one-piece wastepaper bin is able to achieve the function of collecting the crumpled paper, there are many shortcomings respecting the space utilization in transportation and storage. In order to hold more crumpled paper, the volume of the hollow portion of the traditional one-piece paper shredder is quite space consuming. Although it is not necessary to constantly empty the crumpled paper in using the wastepaper bin with a larger volume, it occupies a considerably space in transportation and during the storage period thereby reducing the quantity to be shipped in the limited transportation space of a twenty or forty foot long cargo and increasing the cost of the paper shredder.

SUMMARY OF THE INVENTION

The primary objective of the present invention is to provide a wastepaper bin for a paper shredder to efficiently utilizing the transportation and storage space with the premise on not reducing the receivable capacity.

Another objective of the present invention is to provide a wastepaper bin for a paper shredder capable of reducing the cost of transportation and storage.

In order to achieve the abovementioned objectives, the present invention comprising a bottom portion member with a bottom plate and a lateral wall formed by the upwardly extending peripheral rim thereof unitarily molded with the bottom plate is characterized that an elastic clamping device is respectively disposed adjacent to the top end area on the left and the right lateral walls of the bottom plate.

A top portion member of the wastepaper bin slidably inserts onto the exterior portion of the bottom member and is assembled by a unitarily molded peripheral wall and has a clamping device disposed adjacent to a lower opening area on the left and the right peripheral walls for clamping with the elastic device to fasten the top portion member on the bottom portion member when the top portion member is pulled, relative to the bottom portion member, to a certain positioning location.

An unclamping device is disposed on the left and the right peripheral walls of the top portion wall. A supporting device is disposed on the inner side of the top portion member and adjacent to an upper opening area thereof for supporting the main body of the paper shredder thereon.

Wherein the elastic clamping device has two elastic clamping pieces formed by respectively cutting two unshaped slots spaced in a certain distance on the left and the right lateral walls of the bottom portion member; two free ends of the two elastic pieces are respectively disposed with a convex lug protruding outwardly.

Wherein, the clamping device has two insert slots and the unclamping device has at least two openings disposed in the upper aspect of the elastic clamping pieces.

Wherein, the supporting device has at least two convex lugs protruding inwardly from the inner side of the top portion member.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
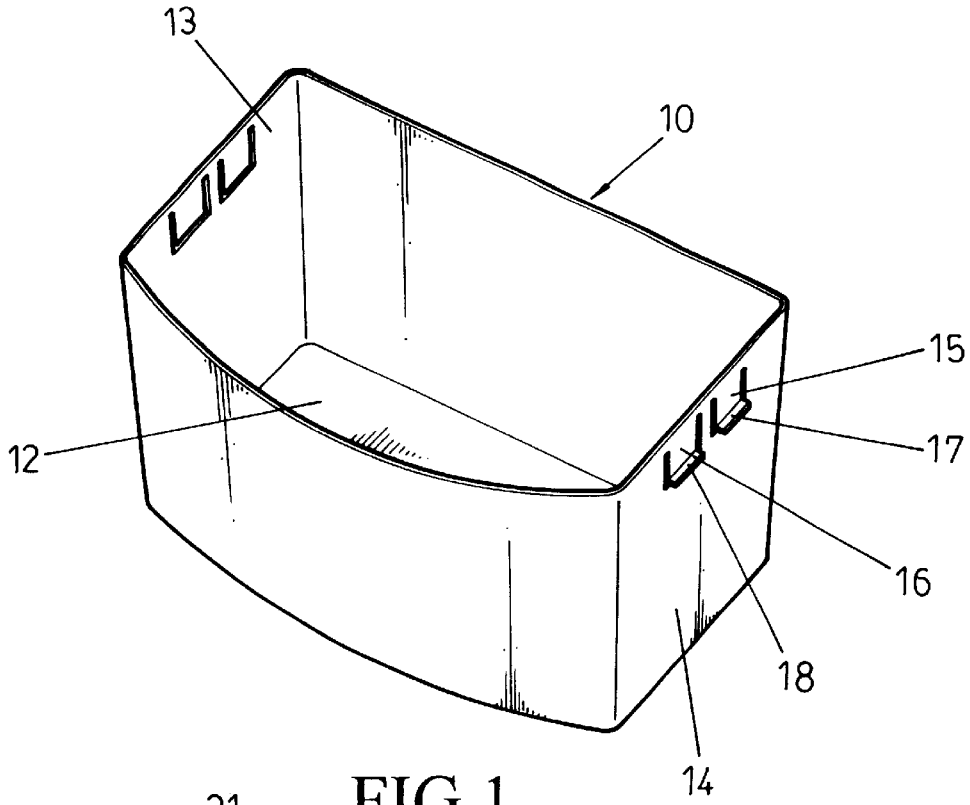
FIG. 1 is a pictorial drawing of a bottom portion member of the present invention.

Referring to FIGS. 1 to 4, as indicated, a bottom portion member (10) of the present invention is a rectangular hollow bucket assembled by a bottom plate (12) and a vertical side wall unitarily molded with the bottom plate (12). On the left and the right lateral walls (13, 14) of the bottom portion member (10), an elastic clamping device is disposed adjacent to an upper opening area. As indicated in the exemplary embodiment in FIG. 1, the clamping device has two elastic clamping pieces (15, 16) formed by cutting two unshaped slots on the left and the right lateral walls (13, 14). Two convex lugs (17, 18) are disposed at the free ends of the elastic clamping pieces (15, 16) protruding outwardly.

Figure 2:
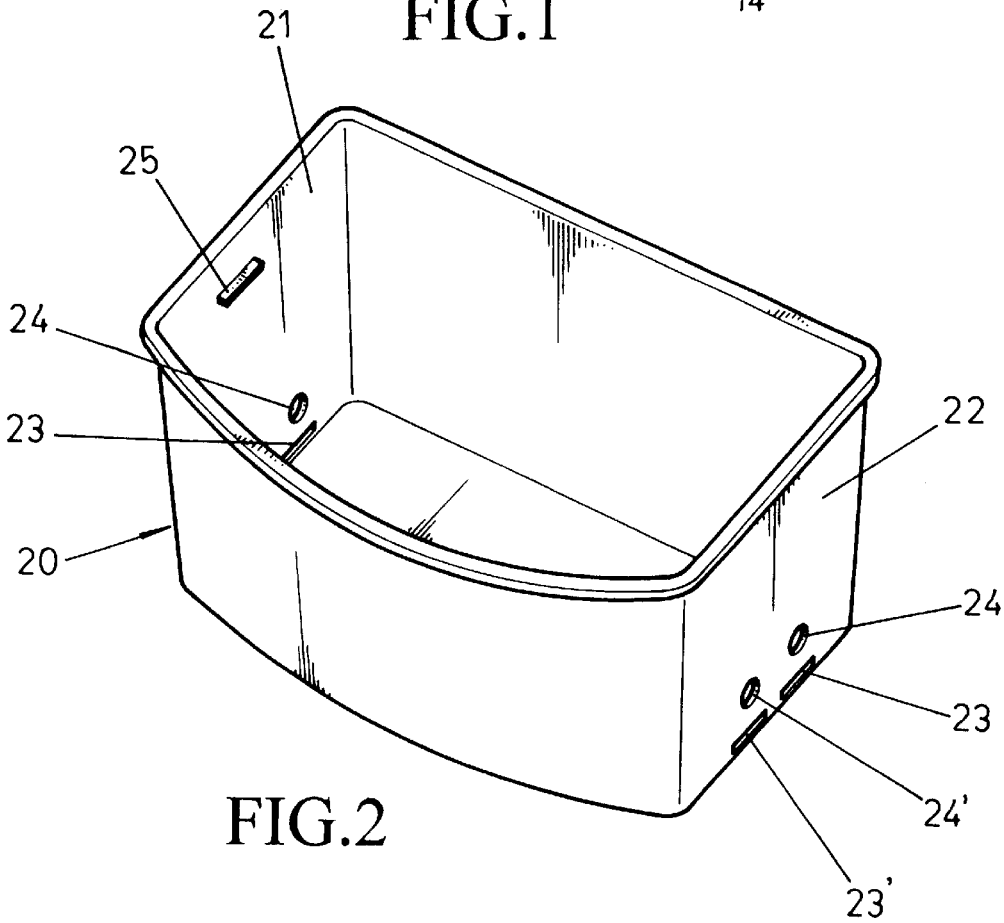
FIG. 2 is a pictorial drawing of a top portion member of the present invention.

FIG. 2 shows the top portion member (20) of the present invention. The top portion member (20) is a rectangular body with a hollowed top and bottom. It is made slightly larger than the bottom portion member (10) such that it inserts onto the exterior portion of the bottom portion member (10). On a left and a right lateral walls (21, 22) of the top portion member (20), two insert slots (23, 23') are respectively disposed adjacent to the lower opening area thereof. An unclamping device is disposed at the upper aspect of the two insert slots (23, 23') in a proper distance such as 2 cm. In the exemplary embodiment in FIG. 2, the unclamping device has two circular holes (24, 24'). A supporting device is disposed on the inner side of the top portion member (20) for supporting a main body of a paper shredder (not shown). Also in the exemplary embodiment in FIG. 2, on the inner sides of the left and right lateral walls (21, 22), the supporting device has two convex lugs (25) disposed adjacent to the upper opening area and protruding inwardly.

Figure 3:
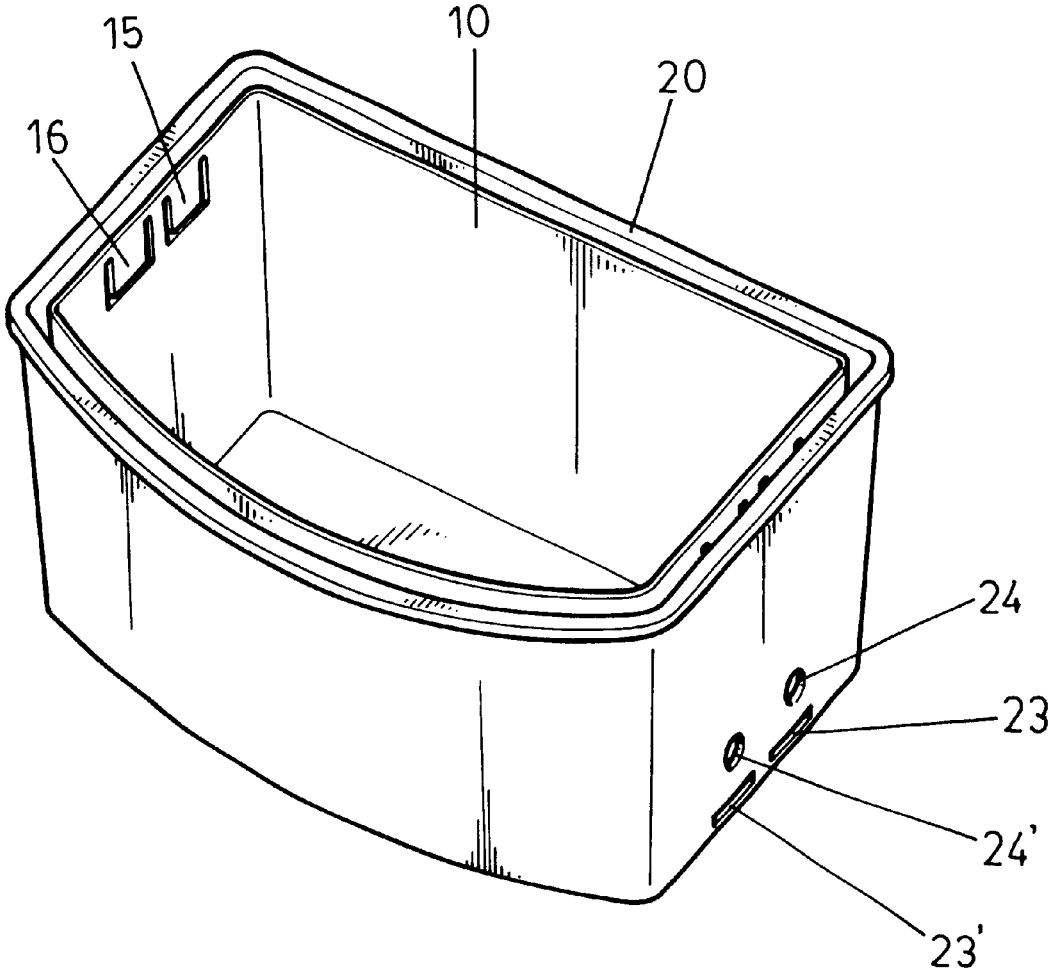
FIG. 3 is a pictorial drawing of the present invention of a wastepaper bin for a paper shredder in a collapsed state.
Figure 4:
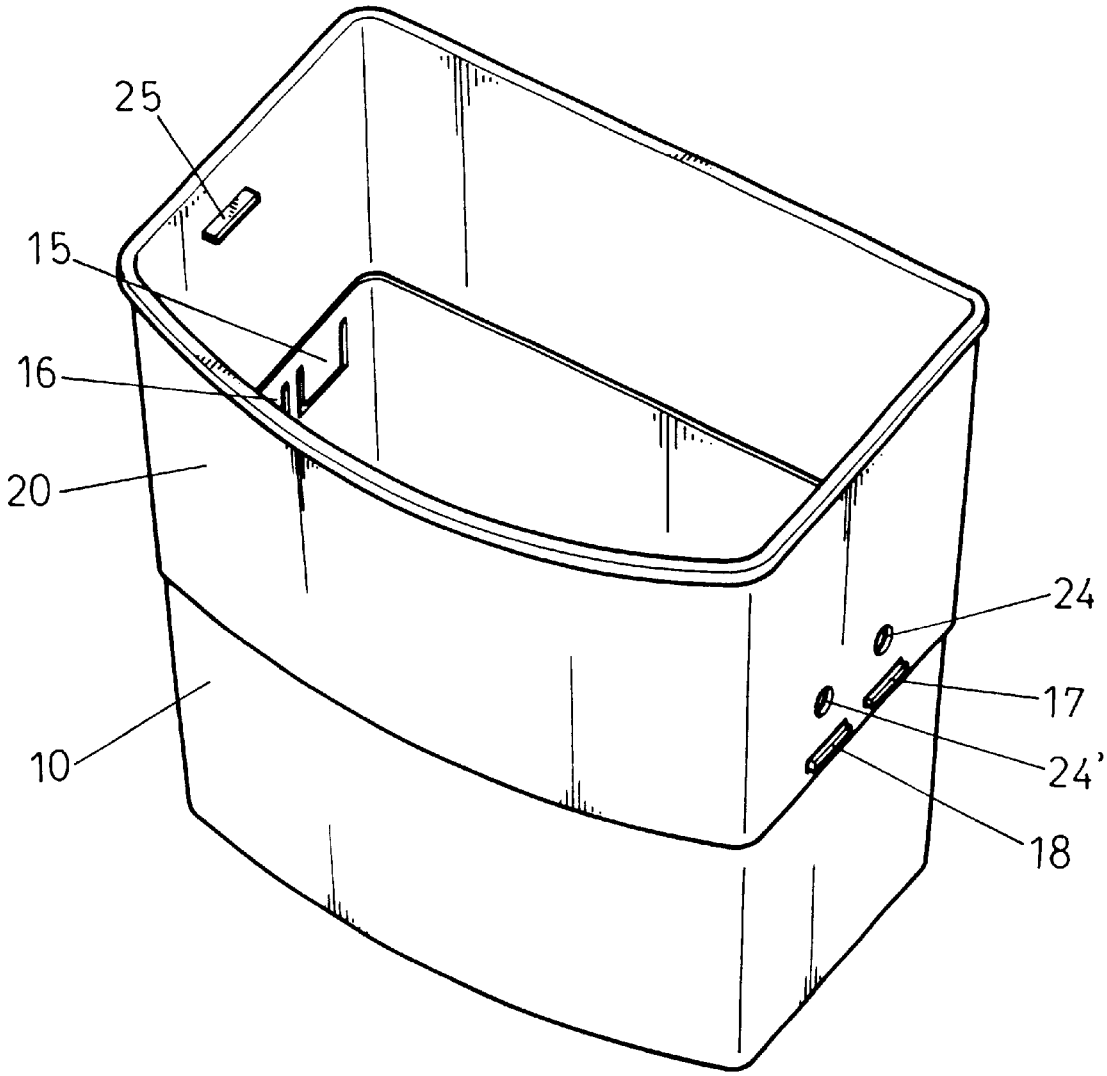
FIG. 4 is a pictorial drawing of the present invention of a wastepaper bin for a paper shredder in an extended state.

FIGS. 3 and 4 show the present invention of a wastepaper bin for a paper shredder in a collapsed state when it is not in use. In this state, the top portion member (20) is inserted onto the exterior portion of the bottom portion member (10); since the top portion member (20) is only slightly larger than the bottom portion member (10), the elastic clamping pieces (15, 16) slightly deform inwardly and elastically due to the outwardly protruding situation of the convex lugs (17, 18).

When using the wastepaper shredder of the present invention, it is merely necessary to upwardly pull the top portion member (20), relative to the bottom portion member (10), to make the elastic clamping pieces (15, 16) reach the positions of the corresponding insert slots (23, 23'). At this moment, the elastic clamping pieces (15, 16) clamp the convex lugs (17, 18) to the insert slots (23, 23') due to their own resuming elasticity; then the top portion member (20) is fixedly locked on a specific position thereby composing a complete wastepaper bin with the bottom portion member (10), as shown in FIG. 4. At this time, the main body of the paper shredder is erected on the wastepaper bin for conducting the shredding operation. When it is necessary to collapse the wastepaper bin, the user merely needs to poke his or her fingers into the circular holes (24, 24') to press the elastic clamping pieces (15, 16) thereby separating the convex lugs (17, 18) from the insert slots (23, 23') for storage.

Figure 5:
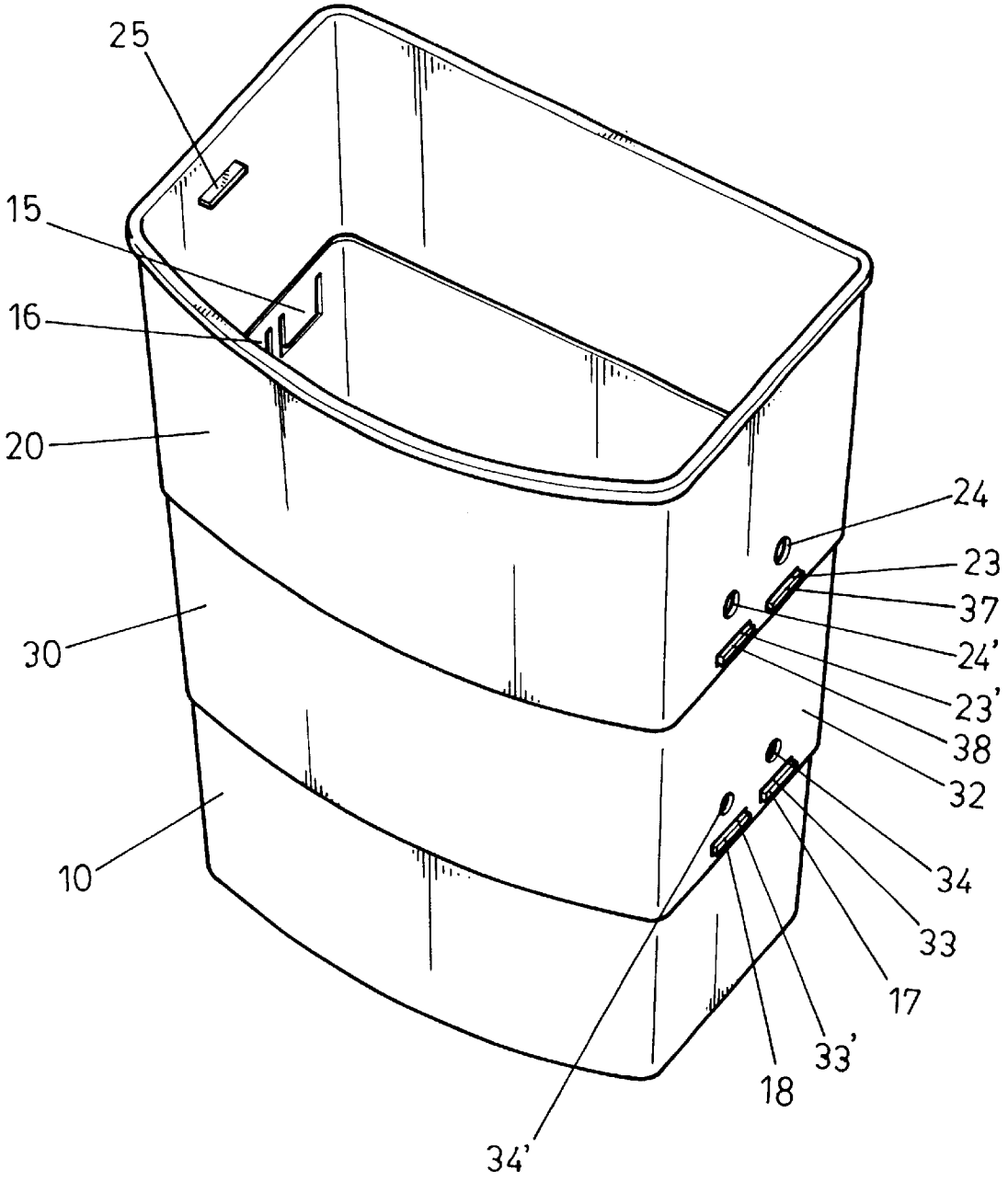
FIG. 5 is a drawing of an exemplary embodiment of the present invention in an extended state.

As indicated in FIG. 5, a middle portion member (30) is also of a rectangular body with a hollow top and a hollow bottom portions as that of a regular top portion member (20). On a left and a right lateral walls (32) of the middle portion member (30), two insert slots (33, 33') are respectively disposed adjacent to a lower opening area. An unclamping device with two circular holes (34, 34') is disposed at the upper aspect of the insert slots (33, 33') to facilitate clamping the convex lugs (17, 18) of the bottom portion member (10) into the insert slots (33, 33'). Furthermore, two convex lugs (37, 38) protruding outwardly on the elastic clamping pieces (15, 16) also insert into the insert slots (23, 23') of the top portion member (20) thereby assembling a complete three-layered wastepaper bin.

Figure 6:
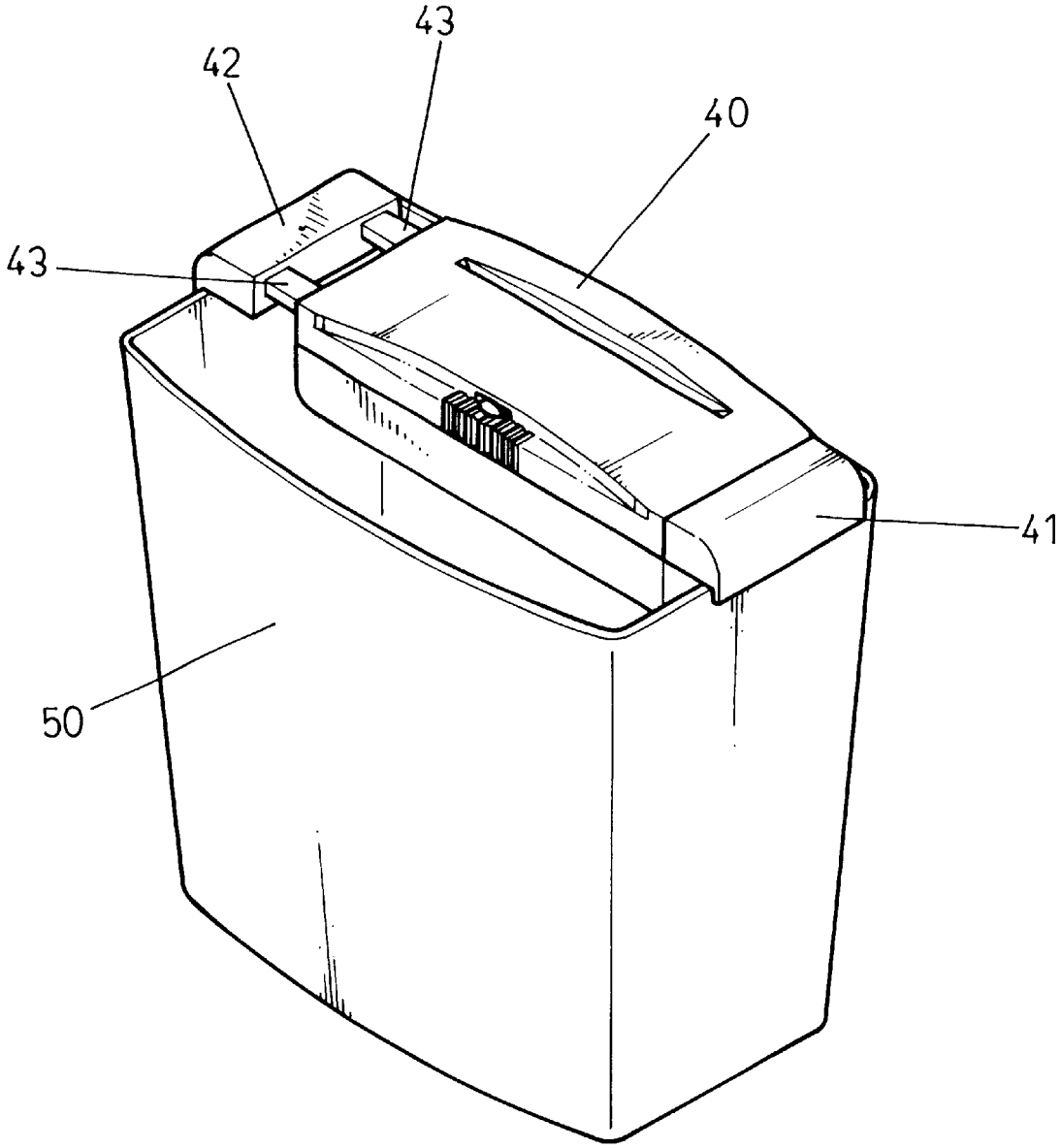
FIG. 6 is a structural and schematic drawing of a main body of the paper shredder of the present invention.

As indicated in FIG. 6, one end of a main body (40) of the paper shredder of the present invention is disposed with a fastening clamp seat (41) in an up-side-down L shape; the other end thereof is disposed with a movable clamp seat (42) also in an up-side-down L shaped. One side of the movable clamp seat (42) is disposed with a link rod (43) which inserts into an inner hole of the main body of the paper shredder for facilitating the left and right displacements of the movable clamp seat (42). Therefore, the consumer only has to purchase the main body (40) of the paper shredder for clamping onto a regular trash can (50) through the utilization of the adjustable fastening clamp seat (41) and the movable clamp seat (42).

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A wastepaper bin for a paper shredder comprising:

a bottom member including a bottom plate and a lateral wall formed by the upwardly extending peripheral rim thereof, said lateral wall being unitarily molded with said bottom plate; wherein a first elastic clamping device is disposed near a top end of a first side of said lateral wall of said bottom plate, and a second elastic clamping device is disposed near a top end of a second side of said lateral wall of said bottom plate, a top member of said wastepaper bin slidably inserts into said bottom member, said top member comprises a unitarily molded peripheral wall, said top member has a first clamping device disposed adjacent to a lower opening area on a first side of said peripheral wall, and said top member has a second clamping device disposed adjacent to a lower opening area on a second side of said peripheral wall, said clamping device of said top member joining with said elastic clamping device of said bottom member to fasten said top member to said bottom member in a first position, and said top member further comprises a first unclamping device disposed on said first side of said peripheral wall, and a second unclamping device disposed on said second side of said peripheral wall; and wherein said elastic clamping device of said bottom member has two elastic clamping pieces formed by cutting two u-shaped slots on said first side of said peripheral wall and two u-shaped slots on said second side of said peripheral wall, and free ends of said elastic clamping pieces comprise a lug protruding outward.

2. The wastepaper bin for a paper shredder according to claim 1, wherein:

said clamping device has two insert slots.

3. The wastepaper bin for a paper shredder according to claim 2, wherein:

said unclamping device has at least two openings disposed at positions corresponding to positions of said elastic clamping pieces.

4. The wastepaper bin for a paper shredder according to claim 1, wherein:

a supporting device has at least two convex lugs protruding inward from an inner side of said top member.

5. The wastepaper bin for a paper shredder according to claim 1, wherein:

a middle member is disposed between said top member and said bottom member, said middle member comprising convex lugs inserted into corresponding ones of said insert slots of said top member, and said middle member further comprises two circular holes and two insert slots, said insert slots receiving convex lugs of said bottom member.

6. The wastepaper bin for a paper shredder according to claim 1, wherein:

a supporting device is disposed on an inner side of said top member adjacent to an upper opening area to support a main body of said paper shredder.

* * * * *